US007967423B2

(12) United States Patent
Katerberg

(10) Patent No.: US 7,967,423 B2
(45) Date of Patent: Jun. 28, 2011

(54) PRESSURE MODULATION CLEANING OF JETTING MODULE NOZZLES

(75) Inventor: James A. Katerberg, Kettering, OH (US)

(73) Assignee: Eastman Kodak Company, Rochester, NY (US)

( * ) Notice: Subject to any disclaimer, the term of this patent is extended or adjusted under 35 U.S.C. 154(b) by 30 days.

(21) Appl. No.: 12/333,340

(22) Filed: Dec. 12, 2008

(65) Prior Publication Data

US 2010/0149233 A1 Jun. 17, 2010

(51) Int. Cl.
*B41J 2/105* (2006.01)
*B41J 2/165* (2006.01)

(52) U.S. Cl. ..... 347/82; 347/22

(58) Field of Classification Search ..... None
See application file for complete search history.

(56) References Cited

U.S. PATENT DOCUMENTS 3,787,882 A * 1/1974 Fillmore et al. ..... 347/6
5,355,158 A * 10/1994 Inada et al. ..... 347/22
6,247,781 B1 * 6/2001 Blum ..... 347/29
6,334,662 B2 1/2002 Hollands
6,457,807 B1 10/2002 Hawkins et al.
6,491,362 B1 12/2002 Jeanmaire
6,505,921 B2 1/2003 Chwalek et al.
6,513,904 B1 2/2003 Taylor et al.
6,554,410 B2 4/2003 Jeanmaire et al.
6,575,564 B1 6/2003 Tsuchiya et al.
6,575,566 B1 6/2003 Jeanmaire et al.
6,588,888 B2 7/2003 Jeanmaire et al.
6,793,328 B2 9/2004 Jeanmaire
6,827,429 B2 12/2004 Jeanmaire et al.
6,851,796 B2 2/2005 Jeanmaire et al.
7,207,648 B2 * 4/2007 Kojima et al. ..... 347/22
2004/0130605 A1 * 7/2004 West ..... 347/73
2006/0017782 A1 1/2006 Nishi et al.

* cited by examiner

*Primary Examiner* — Omar Rojas
(74) *Attorney, Agent, or Firm* — William R. Zimmerli

(57) ABSTRACT

A continuous inkjet printhead includes a jetting module, a fluid system, and a controller. The jetting module includes an array of nozzles. The fluid system includes a liquid source and a pressure control device. The liquid source includes a liquid and is connected in fluid communication with the jetting module. The controller is in electrical communication with the pressure control device of the fluid system and is configured to provide a first signal to the pressure control device to cause the liquid to be ejected as liquid streams through the nozzles of the array at a first pressure sufficient to create a stream of print-selectable drops. The controller is configured to provide a second signal to the pressure control device to cause the liquid to be ejected as liquid streams through the nozzles of the array at a second pressure with the second pressure being less than the first pressure. The controller is configured to provide the first signal to the pressure control device after a period of time.

20 Claims, 5 Drawing Sheets

PRESSURE MODULATION CLEANING OF JETTING MODULE NOZZLES

CROSS REFERENCE TO RELATED APPLICATIONS

Reference is made to commonly-assigned, U.S. Patent Publication No. 2010/0149238, entitled "THERMAL CLEANING OF INDIVIDUAL JETTING MODULE NOZZLES", filed concurrently herewith.

FIELD OF THE INVENTION

This invention relates generally to the field of digitally controlled printing devices, and in particular to techniques for cleaning individual nozzles of a jetting module.

BACKGROUND OF THE INVENTION

In continuous inkjet printing technology, ink is typically supplied to a reservoir of a print head under pressure so as to produce a continuous stream, or jet, of ink from a nozzle that is in liquid communication with the reservoir. Periodic excitations, also referred to as activation pulses, are imposed on the ink stream to break up the stream into ink droplets. The ink droplets are deflected from their initial travel path by a droplet deflection mechanism to either a print medium or an ink capturing mechanism, commonly referred to as a catcher or a gutter.

Debris, for example, dust or dirt, when present in or around nozzles of a printhead can cause ink drops ejected from the nozzle to be misdirected or have inconsistencies in drop size or drop shape which may result in reduced print quality. Various techniques for removing debris located in or around the nozzles of a printhead are known and include, for example, utilizing a cleaning fluid and/or a mechanical cleaning assembly to clean the nozzles of the printhead.

SUMMARY OF THE INVENTION

According to a feature of the present invention, a continuous inkjet printhead includes a jetting module including an array of nozzles, a fluid system including a liquid source and a pressure control device, and a controller in electrical communication with the pressure control device of the fluid system. The liquid source includes a liquid and is connected in fluid communication with the jetting module. The controller is configured to provide a first signal to the pressure control device to cause the liquid to be ejected as liquid streams through the nozzles of the array at a first pressure sufficient to create a stream of print-selectable drops. The controller is also configured to provide a second signal to the pressure control device to cause the liquid to be ejected as liquid streams through the nozzles of the array at a second pressure. The second pressure is less than the first pressure. The controller is configured to again provide the first signal to the pressure control device after a period of time.

According to another feature of the present invention, a method of cleaning the nozzles of a continuous inkjet printhead includes providing a fluid system including a liquid source and a pressure control device, the liquid source including a liquid and being connected in fluid communication with the jetting module, causing the liquid to be ejected as liquid streams through the nozzles of the array at a first pressure sufficient to create a stream of print-selectable drops, causing the liquid to be ejected as liquid streams through the nozzles of the array at a second pressure, the second pressure being less than the first pressure, and causing the liquid to be ejected as liquid streams through the nozzles of the array at the first pressure.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
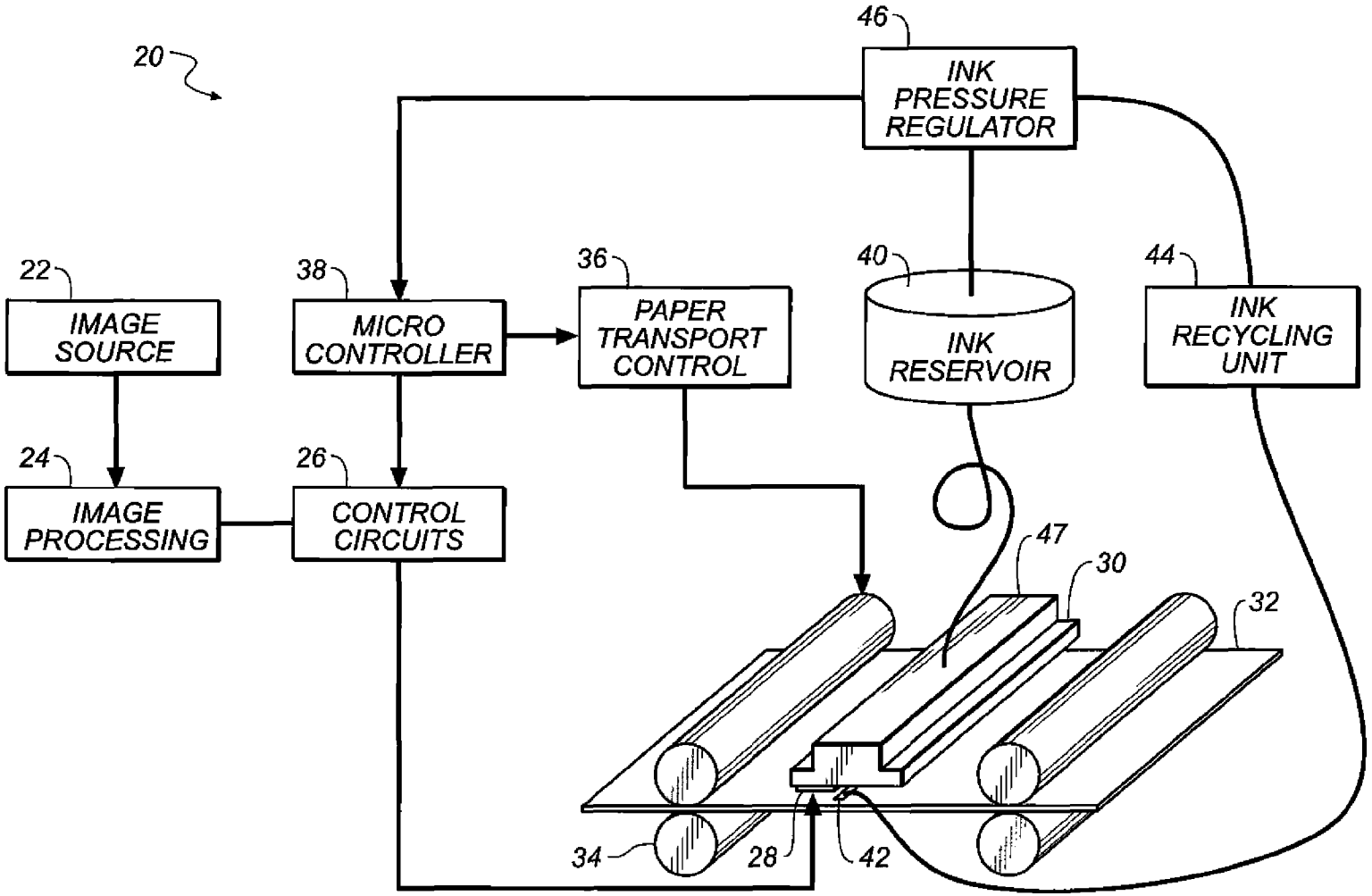
FIG. 1 shows a simplified block schematic diagram of an example embodiment of a printer system made in accordance with the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a printhead and/or printhead components typically used inkjet printing systems. However, many other applications are emerging which use inkjet printheads to emit liquids (other than inks) that need to be finely metered and deposited with high spatial precision. As such, as described herein, the terms "liquid" and/or "ink" refer to any material that can be ejected by the printhead and/or printhead components described below.

Referring to FIG. 1, a continuous ink jet printer system 20 includes an image source 22 such as a scanner or computer which provides raster image data, outline image data in the form of a page description language, or other forms of digital image data. This image data is converted to half-toned bitmap image data by an image processing unit 24 which also stores the image data in memory. A plurality of drop forming mechanism control circuits 26 read data from the image memory and apply time-varying electrical pulses to a drop forming mechanism(s) 28 that are associated with one or more nozzles of a printhead 30. These pulses are applied at an appropriate time, and to the appropriate nozzle, so that drops formed from a continuous ink jet stream will form spots on a recording medium 32 in the appropriate position designated by the data in the image memory.

Recording medium 32 is moved relative to printhead 30 by a recording medium transport system 34, which is electronically controlled by a recording medium transport control system 36, and which in turn is controlled by a micro-controller 38. The recording medium transport system shown in FIG. 1 is a schematic only, and many different mechanical configurations are possible. For example, a transfer roller could be used as recording medium transport system 34 to facilitate transfer of the ink drops to recording medium 32. Such transfer roller technology is well known in the art. In the case of page width printheads, it is most convenient to move recording medium 32 past a stationary printhead. However, in the case of scanning print systems, it is usually most convenient to move the printhead along one axis (the sub-scanning direction) and the recording medium along an orthogonal axis (the main scanning direction) in a relative raster motion.

Ink is contained in an ink reservoir 40 under pressure. In the non-printing state, continuous ink jet drop streams are unable to reach recording medium 32 due to an ink catcher 42 that blocks the stream and which may allow a portion of the ink to be recycled by an ink recycling unit 44. The ink recycling unit reconditions the ink and feeds it back to reservoir 40. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 40 under the control of ink pressure regulator 46. Alternatively, the ink reservoir can be left unpressurized, or even under a reduced pressure (vacuum), and a pump is employed to deliver ink from the ink reservoir under pressure to the printhead 30. In such an embodiment, the ink pressure regulator 46 can comprise an ink pump control system. As shown in FIG. 1, catcher 42 is a type of catcher commonly referred to as a "knife edge" catcher.

The ink is distributed to printhead 30 through an ink channel 47. The ink preferably flows through slots and/or holes etched through a silicon substrate of printhead 30 to its front surface, where a plurality of nozzles and drop forming mechanisms, for example, heaters, are situated. When printhead 30 is fabricated from silicon, drop forming mechanism control circuits 26 can be integrated with the printhead. Printhead 30 also includes a deflection mechanism (not shown in FIG. 1) which is described in more detail below with reference to FIGS. 2 and 3.

Figure 2:
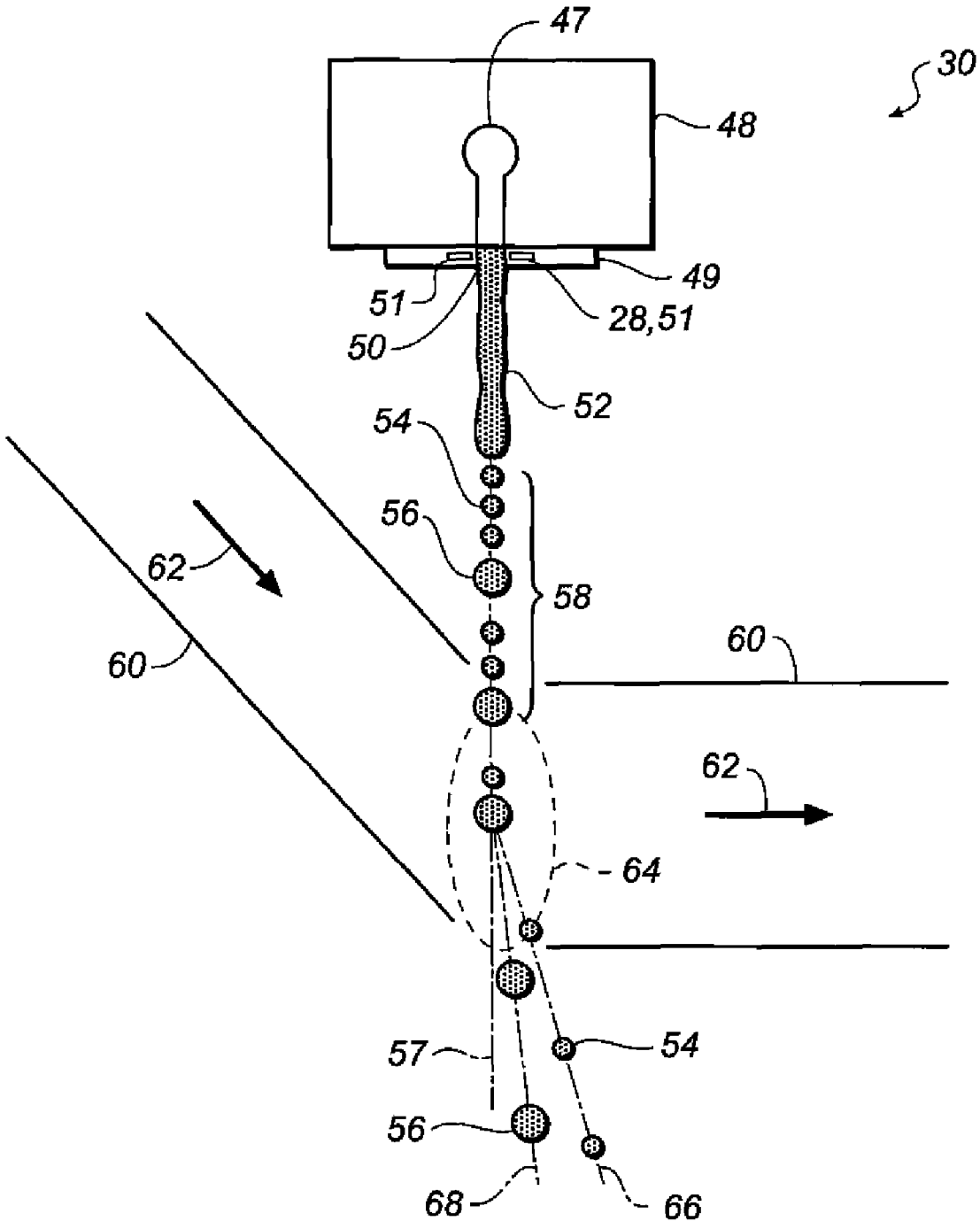
FIG. 2 is a schematic view of an example embodiment of a continuous printhead made in accordance with the present invention.
Figure 3:
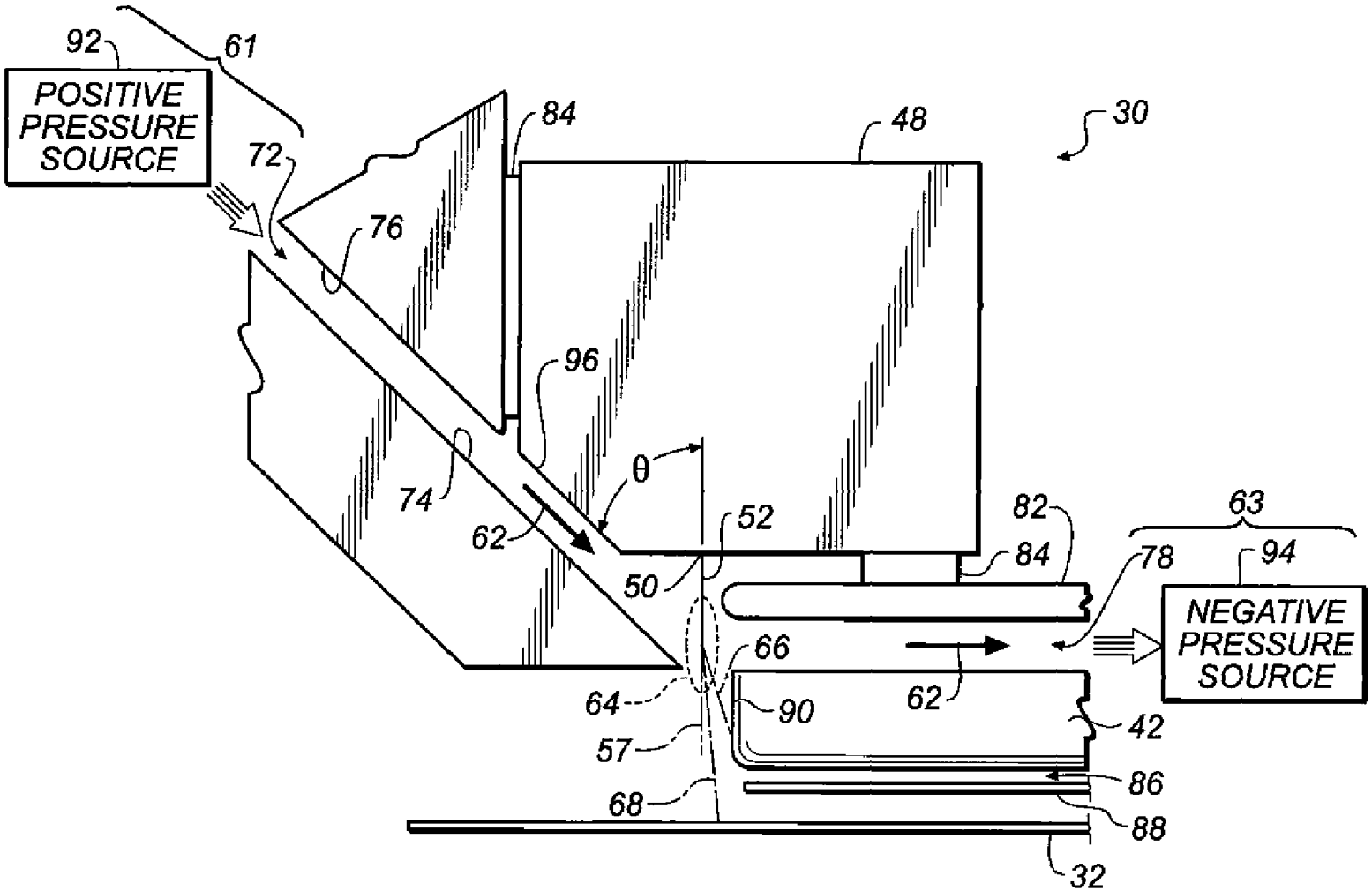
FIG. 3 is a schematic view of an example embodiment of a continuous printhead made in accordance with the present invention.

Referring to FIG. 2, a schematic view of continuous liquid printhead 30 is shown. A jetting module 48 of printhead 30 includes an array or a plurality of nozzles 50 formed in a nozzle plate 49. In FIG. 2, nozzle plate 49 is affixed to jetting module 48. However, as shown in FIG. 3, nozzle plate 49 can be integrally formed with jetting module 48.

Liquid, for example, ink, is emitted under pressure through each nozzle 50 of the array to form filaments of liquid 52. In FIG. 2, the array or plurality of nozzles extends into and out of the figure.

Jetting module 48 is operable to form liquid drops having a first size and liquid drops having a second size through each nozzle. To accomplish this, jetting module 48 includes a drop stimulation or drop forming device 28, for example, a heater or a piezoelectric actuator, that, when selectively activated, perturbs each filament of liquid 52, for example, ink, to induce portions of each filament to breakoff from the filament and coalesce to form drops 54, 56.

In FIG. 2, drop forming device 28 is a heater 51 located in a nozzle plate 49 on one or both sides of nozzle 50. This type of drop formation is known and has been described in, for example, U.S. Pat. No. 6,457,807 B1, issued to Hawkins et al., on Oct. 1, 2002; U.S. Pat. No. 6,491,362 B1, issued to Jeanmaire, on Dec. 10, 2002; U.S. Pat. No. 6,505,921 B2, issued to Chwalek et al., on Jan. 14, 2003; U.S. Pat. No. 6,554,410 B2, issued to Jeanmaire et al., on Apr. 29, 2003; U.S. Pat. No. 6,575,566 B1, issued to Jeanmaire et al., on Jun. 10, 2003; U.S. Pat. No. 6,588,888 B2, issued to Jeanmaire et al., on Jul. 8, 2003; U.S. Pat. No. 6,793,328 B2, issued to Jeanmaire, on Sep. 21, 2004; U.S. Pat. No. 6,827,429 B2, issued to Jeanmaire et al., on Dec. 7, 2004; and U.S. Pat. No. 6,851,796 B2, issued to Jeanmaire et al., on Feb. 8, 2005, the disclosures of which are incorporated by reference herein.

Typically, one drop forming device 28 is associated with each nozzle 50 of the nozzle array. However, a drop forming device 28 can be associated with groups of nozzles 50 or all of nozzles 50 of the nozzle array.

When printhead 30 is in operation, drops 54, 56 are typically created in a plurality of sizes, for example, in the form of large drops 56, a first size, and small drops 54, a second size. The ratio of the mass of the large drops 56 to the mass of the small drops 54 is typically approximately an integer between 2 and 10. A drop stream 58 including drops 54, 56 follows a drop path or trajectory 57.

Printhead 30 also includes a gas flow deflection mechanism 60 that directs a flow of gas 62, for example, air, past a portion of the drop trajectory 57. This portion of the drop trajectory is called the deflection zone 64. As the flow of gas 62 interacts with drops 54, 56 in deflection zone 64 it alters the drop trajectories. As the drop trajectories pass out of the deflection zone 64 they are traveling at an angle, called a deflection angle, relative to the undeflected drop trajectory 57.

Small drops 54 are more affected by the flow of gas than are large drops 56 so that the small drop trajectory 66 diverges from the large drop trajectory 68. That is, the deflection angle for small drops 54 is larger than for large drops 56. The flow of gas 62 provides sufficient drop deflection and therefore sufficient divergence of the small and large drop trajectories so that catcher 42 (shown in FIGS. 1 and 3) can be positioned to intercept one of the small drop trajectory 66 and the large drop trajectory 68 so that drops following the trajectory are collected by catcher 42 while drops following the other trajectory bypass the catcher and impinge a recording medium 32 (shown in FIGS. 1 and 3).

When catcher 42 is positioned to intercept large drop trajectory 68, small drops 54 are deflected sufficiently to avoid contact with catcher 42 and strike the print media. As the small drops are printed, this is called small drop print mode. When catcher 42 is positioned to intercept small drop trajectory 66, large drops 56 are the drops that print. This is referred to as large drop print mode.

Referring to FIG. 3, jetting module 48 includes an array or a plurality of nozzles 50. Liquid, for example, ink, supplied through channel 47, is emitted under pressure through each nozzle 50 of the array to form filaments of liquid 52. In FIG. 3, the array or plurality of nozzles 50 extends into and out of the figure.

Drop stimulation or drop forming device 28 (shown in FIGS. 1 and 2) associated with jetting module 48 is selectively actuated to perturb the filament of liquid 52 to induce portions of the filament to break off from the filament to form drops. In this way, drops are selectively created in the form of large drops and small drops that travel toward a recording medium 32.

Positive pressure gas flow structure 61 of gas flow deflection mechanism 60 is located on a first side of drop trajectory 57. Positive pressure gas flow structure 61 includes first gas flow duct 72 that includes a lower wall 74 and an upper wall 76. Gas flow duct 72 directs gas supplied from a positive pressure source 92 at downward angle θ of approximately a 45° toward drop deflection zone 64. An optional seal(s) 84 provides an air seal between jetting module 48 and upper wall 76 of gas flow duct 72.

Upper wall 76 of gas flow duct 72 does not need to extend to drop deflection zone 64 (as shown in FIG. 2). In FIG. 3, upper wall 76 ends at a wall 96 of jetting module 48. Wall 96 of jetting module 48 serves as a portion of upper wall 76 ending at drop deflection zone 64.

Negative pressure gas flow structure 63 of gas flow deflection mechanism 60 is located on a second side of drop trajectory 57. Negative pressure gas flow structure includes a second gas flow duct 78 located between catcher 42 and an upper wall 82 that exhausts gas flow from deflection zone 64. Second duct 78 is connected to a negative pressure source 94 that is used to help remove gas flowing through second duct 78. An optional seal(s) 84 provides an air seal between jetting module 48 and upper wall 82.

As shown in FIG. 3, gas flow deflection mechanism 60 includes positive pressure source 92 and negative pressure source 94. However, depending on the specific application contemplated, gas flow deflection mechanism 60 can include only one of positive pressure source 92 and negative pressure source 94.

Gas supplied by first gas flow duct 72 is directed into the drop deflection zone 64, where it causes large drops 56 to follow large drop trajectory 68 and small drops 54 to follow small drop trajectory 66. As shown in FIG. 3, small drop trajectory 66 is intercepted by a front face 90 of catcher 42. Small drops 54 contact face 90 and flow down face 90 and into a liquid return duct 86 located or formed between catcher 42 and a plate 88. Collected liquid is either recycled and returned to ink reservoir 40 (shown in FIG. 1) for reuse or discarded. Large drops 56 bypass catcher 42 and travel on to recording medium 32. Alternatively, catcher 42 can be positioned to intercept large drop trajectory 68. Large drops 56 contact catcher 42 and flow into a liquid return duct located or formed in catcher 42. Collected liquid is either recycled for reuse or discarded.

As shown in FIG. 3, catcher 42 is a type of catcher commonly referred to as a "Coanda" catcher. However, the "knife edge" catcher shown in FIG. 1 and the "Coanda" catcher shown in FIG. 3 are interchangeable and work equally well.

Figure 4:
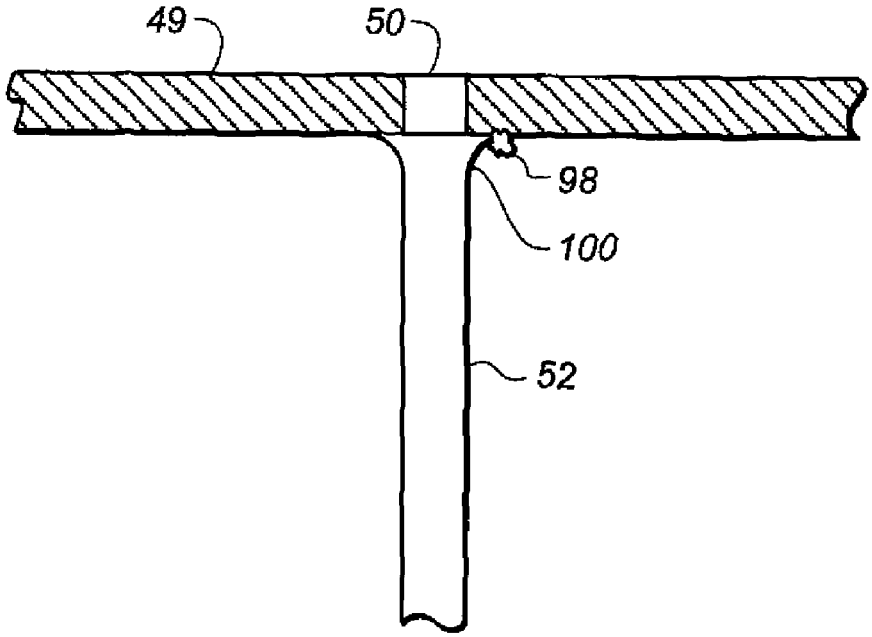
FIG. 4 is a schematic illustration of a stream of liquid emitted from the nozzle at a normal operating pressure.

Referring to FIG. 4, micro-controller 38 sends a signal to ink pressure regulator 46 that causes the ink to be supplied to the printhead at a first pressure by pressure regulator 46. The ink pressure at the printhead causes the ink ejected from each nozzle 50 of the array to form filaments of liquid 52, as shown in FIG. 4. The pressure applied is sufficient to establish a continuous stream of liquid from the nozzles 50. As previously explained, the ink pressure suitable for optimal operation will depend on a number of factors. However, typical operating ink pressures are usually between 40 and 80 psi. Liquid filament 52 includes a meniscus 100 which spreads across the nozzle plate 49 according to the properties of the liquid. The presence of particulates or other contaminants on the nozzle plate that contacts the meniscus 100 can cause the directionality of the filament 52 to be adversely affected.

Micro-controller 38 is also configured to send a second signal to ink pressure regulator 46 that causes the ink pressure regulator 46 to supply ink to the printhead at a second pressure. It is preferable for the change in pressure to be gradual so as to decrease, or even eliminate, pressure surging on the filters of the fluid system which can cause particle shedding in the fluid system. However, the rate of change of pressure typically depends on the specific application contemplated. The second pressure is lower than the pressure normally used for printing, but is still sufficient to create a continuous stream of fluid from the nozzle 50. Preferably, the second pressure is between 30 and 35 psi. However, the particular pressure depends on the specific application contemplated and is affected by ink composition and viscosity, nozzle size, the contact angle with the nozzle plate, etc.

Figure 5:
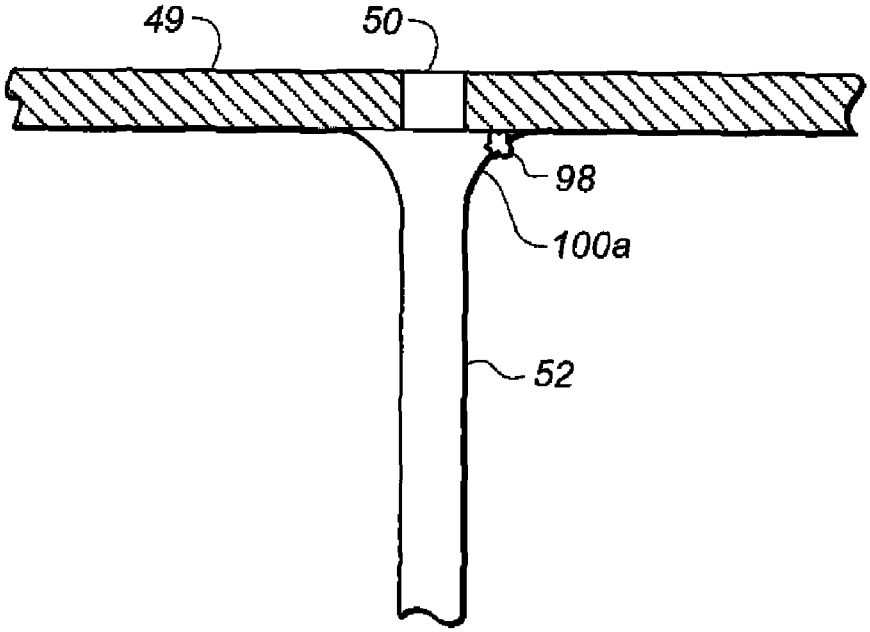
FIG. 5 is a schematic illustration of a stream of liquid emitted from the nozzle at a second pressure, the second pressure being lower than the normal operating pressure.

Referring to FIG. 5, when the ink pressure regulator 46 applies the second pressure to ink reservoir 40, the meniscus 100A expands in diameter, spreading out over the nozzle plate 49. Meniscus 100A expands to envelop contaminants 98 that can be present on the nozzle plate 49, including dried ink, dirt, or other particles. Once any contaminants 98 have been dissolved or rinsed away by the expanded meniscus 100A or after a period of time, micro-controller 38 again sends the first signal to the ink pressure regulator 46. The signal is received by ink pressure regulator 46, and the pressure is increased back to the normal operating pressure. As the pressure increases, the meniscus 100A retracts. With the contaminant 98 removed from the area of the meniscus, the desired directionality of the liquid filaments 52 emitted from each of the nozzles 50 is restored.

Typically, the second pressure is provided to the ink reservoir 40 for a duration of at least 3 seconds, preferably for a duration of 5 seconds, and more preferably for a duration of between 5 and 60 seconds. However, the particular duration of application of the second lower pressure depends on the specific application contemplated. In some cases, a longer duration can be used to dissolve the contaminant 98, while in other cases, a shorter duration can be sufficient to wash the contaminant 98 away from the surface of the nozzle plate 49. Additionally, the pressure change process can be repeated, if necessary, to remove the contaminants 98.

As slower moving drops or jets are more easily deflected than drops moving at a higher velocity, continued operation of the drop deflection system at the normal levels can lead to over-deflection of drops when the second pressure is being applied. Over deflected drops can adversely affect the drop deflection mechanism. For example, over deflected drops can enter the negative gas flow duct or strike other elements of the drop deflection mechanism. Furthermore, the change in the pressure applied to the ink reservoir can result in changes of drop break-off characteristics of the fluid. These changes in characteristics can include increased satellite drop formation and drop break-off length. An increase in satellite drop formation typically results in smaller than normal drops that are more easily deflected. On the other hand, an increase in break-off length can result in drop break-up after the filament of liquid passes the drop deflection mechanism, for example, the gas flow ducts of a gas flow drop deflection mechanism. Therefore, in some embodiments of the invention, when the micro-controller 38 provides the second signal to the ink pressure regulator 46 to lower the pressure, the micro-controller 38 is also configured to adjust the operating parameters of the drop deflection mechanism. The micro-controller 38 can turn off the drop deflection mechanism or causes operation at a lower operating level, for example, by reducing the gas flow velocity. The specific adjustments to the parameters depend on the specific application contemplated because the specific values employed depend on the alignment spacing of the nozzle array relative to the catcher and drop deflection mechanism, the nozzle diameter, ink pressure, and the level of drop stimulation used, if any. When the micro-controller 38 again provides the first signal to the ink pressure regulator 46, the pressure is increased back to the normal operating pressure. The micro-controller 38 then re-adjusts the parameters of the drop deflection mechanism to normal.

Figure 6:
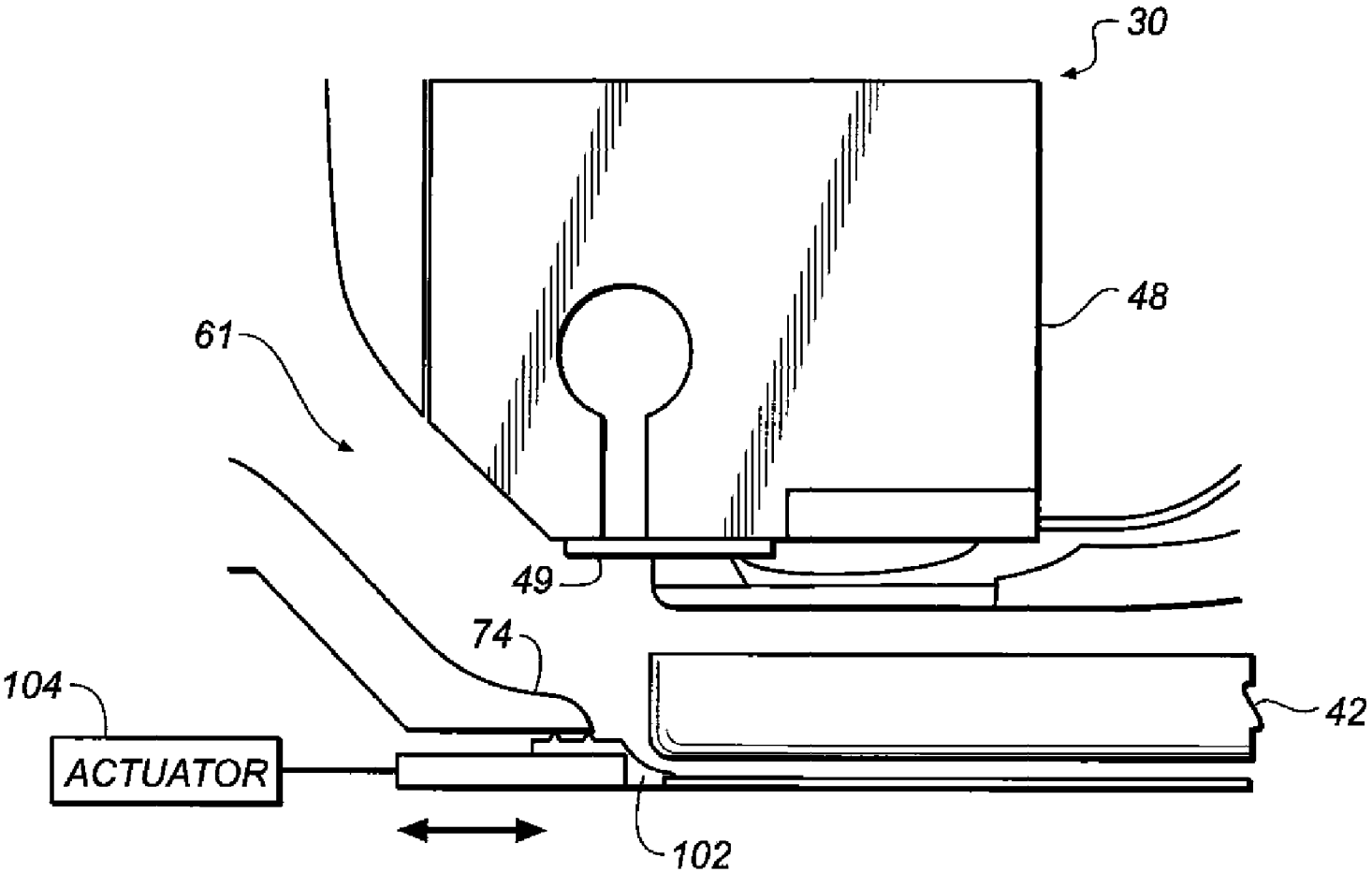
FIG. 6 is a schematic illustration of an example embodiment of a continuous printhead including an eyelid made in accordance with the present invention.

In other embodiments of the invention, such as the one shown in FIG. 6, the printhead 30 includes a sealing member, commonly referred to as an eyelid 102, that provides printhead 30 with a liquid seal below catcher 42. When eyelid 102 seals against the bottom of catcher 42, ink or cleaning liquids that flow through printhead 30 can be contained in printhead 30. An actuator 104 is used to move the eyelid 102 between sealed (a closed position) and unsealed (an open position) locations. The actuator can be a stepper motor, a solenoid, or any other actuator known to those in the art. When eyelid 102 is in a sealed location, it fits tight against the bottom of catcher 42 and against positive gas flow duct wall 74, so that liquid is prevented from reaching the print media 32.

Typically, the eyelid is closed prior to the controller providing the second signal to the pressure regulator. When the controller provides the second signal to the pressure control device and the eyelid is in the closed position, liquid is contained within printhead 30. Even though the liquid is contained within the printhead when the eyelid is in the sealed location, the liquid can still be removed from the printhead through catcher 42 if desired. When the printing system is ready to print and the controller applies the first signal to the pressure regulator, the actuator moves the arm connected to the eyelid 102 to retract the eyelid 102 to an unsealed location. When eyelid 102 is in the unsealed position, drops ejected from the jetting module 48 can contact the print media 32 or be deflected into catcher 42 by gas flow deflection mechanism 60.

The cleaning method and apparatus described above can be implemented by the micro-controller 38 as the result of a command issued by the printer operator. Alternatively, the continuous ink jet printer system can include conventional sensors operable to detect the presence of misdirected liquid filaments. These types of sensors include those that sense the filament directionality directly or that can detect directionality errors based on detecting various artifacts in the printed output. The cleaning method and apparatus described above can also be incorporated as part of a preventive maintenance program. For example, cleaning can be carried out between print jobs or while the printing system is being resupplied with recording medium.

The invention has been described in detail with particular reference to certain preferred embodiments thereof, but it will be understood that variations and modifications can be effected within the scope of the invention. For example, the invention has been described for use in a continuous ink jet printer system that employs a gas flow drop deflection mechanism, thermal drop stimulation devices, and nozzle plates fabricated out of silicon. However, the invention can also be employed in continuous ink jet printer systems that use electrostatic drop deflection mechanisms, pressure modulation or vibrating body stimulation devices, and nozzles plates fabricated out of other types of materials.

PARTS LIST

20 Continuous ink jet printer system
22 Image source
24 Image processing unit
26 Drop forming mechanism control circuits
28 Drop stimulation device
30 Printhead
32 Recording medium
34 Recording medium transport system
36 Recording medium transport control system
38 Micro-controller
40 Ink reservoir
42 Catcher
47 Ink channel
48 Jetting module
49 Nozzle plate
50 Nozzles
51 Heater
52 Filament of liquid
54 Small drops
56 Large drops
57 Drop trajectory
58 Drop stream
60 Gas flow deflection mechanism
61 Positive pressure gas flow structure
62 Flow of gas
63 Negative pressure gas flow structure
64 Drop deflection zone
66 Small drop trajectory
68 Large drop trajectory
72 Gas flow duct
74 Lower wall
76 Upper wall
78 Second gas flow duct
82 Upper wall
84 Seal
86 Liquid return duct
88 Plate
90 Front face
92 Positive pressure source
94 Negative pressure source
96 Wall
98 Contaminant
100 Meniscus
100A Expanded meniscus
102 Eyelid
104 Actuator

The invention claimed is:

1. A continuous inkjet printer system including an apparatus that cleans an array of nozzles of a jetting module of a continuous inkjet printhead comprising:

a jetting module including an array of nozzles;

a fluid system including a liquid source and a pressure control device, the liquid source including a liquid and being connected in fluid communication with the jetting module;

a controller in electrical communication with the pressure control device of the fluid system, the controller being configured to provide a first signal to the pressure control device to cause the liquid to be ejected as liquid streams through the nozzles of the array at a first pressure sufficient to create a stream of print-selectable drops, and the controller being configured to provide a second signal to the pressure control device to cause the liquid to be ejected as liquid streams through the nozzles of the array at a second pressure, the second pressure being less than the first pressure, and the controller being configured to again provide the first signal to the pressure control device after a period of time, wherein the second pressure is sufficiently lower than the first pressure such that the meniscus expands sufficiently to allow contaminants to be dissolved or rinsed away.

2. The system of claim 1, further comprising:

a stimulation device associated with each nozzle of the array, the stimulation device being operable to break the liquid stream into liquid droplets.

3. The system of claim 2, wherein the stimulation device is a heater.

4. The system of claim 1, further comprising:

a drop deflection mechanism, wherein the controller is configured to adjust an operating parameter of the drop deflection mechanism when the controller provides the second signal to the pressure control device.

5. The system of claim 1, further comprising:

an eyelid having a closed position that contains drops within the printhead, the eyelid being in the closed position when the controller provides the second signal to the pressure control device.

6. A method of cleaning nozzles of a continuous inkjet printhead comprising:

providing a jetting module including an array of nozzles;

providing a fluid system including a liquid source and a pressure control device, the liquid source including a liquid and being connected in fluid communication with the jetting module;

causing the liquid to be ejected as liquid streams through the nozzles of the array at a first pressure sufficient to create a stream of print-selectable drops;

causing the liquid to be ejected as liquid streams through the nozzles of the array at a second pressure, the second pressure being less than the first pressure, wherein the second pressure is sufficiently lower than the first pressure such that the meniscus expands sufficiently to allow contaminants to be dissolved or rinsed away; and causing the liquid to be ejected as liquid streams through the nozzles of the array at the first pressure.

7. The method of claim 6, further comprising:

providing an eyelid; and closing the eyelid prior to causing the liquid to be ejected as liquid streams through the nozzles of the array at a second pressure.

8. The method of claim 6, further comprising:

providing a drop deflection mechanism, wherein causing the liquid to be ejected as liquid streams through the nozzles of the array at a second pressure includes adjusting an operating parameter of the drop deflection mechanism.

9. The method of claim 8, the drop deflection mechanism including a gas flow deflection mechanism that provides a gas flow, wherein adjusting the operating parameter of the drop deflection mechanism includes decreasing the velocity of the gas flow provided by the gas flow deflection mechanism.

10. The method of claim 8, the drop deflection mechanism including a gas flow deflection mechanism that provides a gas flow, wherein adjusting the operating parameter of the drop deflection mechanism includes turning off the gas flow.

11. The method of claim 6, further comprising:

providing a controller in electrical communication with the pressure control device of the fluid system, wherein:

causing the liquid to be ejected as liquid streams through the nozzles of the array at a first pressure sufficient to create a stream of print-selectable drops includes using the controller to provide a first signal to the pressure control device to cause the liquid to be ejected as liquid streams through the nozzles of the array at the first pressure sufficient to create a stream of print-selectable drops;

causing the liquid to be ejected as liquid streams through the nozzles of the array at a second pressure includes using the controller to provide a second signal to the pressure control device to cause the liquid to be ejected as liquid streams through the nozzles of the array at the second pressure; and causing the liquid to be ejected as liquid streams through the nozzles of the array at the first pressure includes using the controller to provide the first signal to the pressure control device after a period of time.

12. The method of claim 6, further comprising:

repeating the steps of causing the liquid to be ejected as liquid streams through the nozzles of the array at a second pressure, the second pressure being less than the first pressure and causing the liquid to be ejected as liquid streams through the nozzles of the array at the first pressure.

13. The method of claim 6, wherein the step of causing the liquid to be ejected as liquid streams through the nozzles of the array at a second pressure, the second pressure being less than the first pressure, follows a step of determining a need to clean the array of nozzles.

14. The method of claim 13, wherein the step of determining the need to clean the array of nozzles includes a printer operator issuing a command to clean the array of nozzles.

15. The method of claim 13, wherein the step of determining the need to clean the array of nozzles includes detecting the presence of misdirected liquid filaments.

16. The method of claim 13, wherein the step of determining the need to clean the array of nozzles includes cleaning the array of nozzles as part of a preventive maintenance program.

17. The method of claim 6, wherein the second pressure is lower than the first pressure and still sufficient to eject continuous streams of liquid through the array of nozzles.

18. A method of cleaning nozzles of a continuous inkjet printhead comprising:

providing a jetting module including an array of nozzles;

providing a fluid system including a liquid source and a pressure control device, the liquid source including a liquid and being connected in fluid communication with the jetting module;

providing a drop deflection mechanism;

causing the liquid to be ejected as liquid streams through the nozzles of the array at a first pressure sufficient to create a stream of print-selectable drops;

causing the liquid to be ejected as liquid streams through the nozzles of the array at a second pressure, the second pressure being less than the first pressure, wherein causing the liquid to be ejected as liquid streams through the nozzles of the array at the second pressure includes adjusting an operating parameter of the drop deflection mechanism; and causing the liquid to be ejected as liquid streams through the nozzles of the array at the first pressure.

19. The method of claim 18, the drop deflection mechanism including a gas flow deflection mechanism that provides a gas flow, wherein adjusting the operating parameter of the drop deflection mechanism includes decreasing the velocity of the gas flow provided by the gas flow deflection mechanism.

20. The method of claim 18, the drop deflection mechanism including a gas flow deflection mechanism that provides a gas flow, wherein adjusting the operating parameter of the drop deflection mechanism includes turning off the gas flow.

* * * * *